US007572076B2

(12) United States Patent
Nakajima

(10) Patent No.: US 7,572,076 B2
(45) Date of Patent: Aug. 11, 2009

(54) PRINTER AND PRINTING METHOD

(75) Inventor: Shinichi Nakajima, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 507 days.

(21) Appl. No.: 11/295,606

(22) Filed: Dec. 7, 2005

(65) Prior Publication Data

US 2006/0125873 A1 Jun. 15, 2006

(30) Foreign Application Priority Data

Dec. 9, 2004 (JP) ..... 2004-357095

(51) Int. Cl.

| | |
|---|---|
| ***B41J 2/01*** | (2006.01) |
| ***B41J 29/38*** | (2006.01) |
| ***B41J 19/00*** | (2006.01) |
| ***B41J 19/02*** | (2006.01) |

(52) U.S. Cl. ..... 400/76; 400/319; 400/337; 400/283; 347/37

(58) Field of Classification Search ..... None
See application file for complete search history.

(56) References Cited

U.S. PATENT DOCUMENTS

2005/0147444 A1* 7/2005 Dinca et al. ..... 400/76

FOREIGN PATENT DOCUMENTS

| | | | |
|---|---|---|---|
| JP | 62-80076 A | | 4/1987 |
| JP | 09076484 A | * | 3/1997 |
| JP | 2003/266867 A | | 9/2003 |
| JP | 2005262773 A | * | 9/2005 |

* cited by examiner

*Primary Examiner*—Daniel J Colilla
(74) *Attorney, Agent, or Firm*—Sughrue Mion, PLLC

(57) ABSTRACT

A printer includes a printing part that prints inputted printing information on paper while moving by gravity and supports that support the printing part and the printing medium facing each other so that the printing part is movable in the gravity direction. The printing part corrects the inputted printing information according to a moving distance and a moving speed of the printing part and prints corrected printing information on the printing medium.

4 Claims, 6 Drawing Sheets

PRINTER AND PRINTING METHOD

BACKGROUND OF THE INVENTION

1. Field of the Invention

The present invention relates to a printer and a printing method and, particularly, to a printer and a printing method that print information on a printing medium by moving a printing part or a printing medium in the gravity direction.

2. Description of the Related Art

Printers that are placed on a table and make printing by feeding a printing medium such as paper horizontally with respect to a table surface are widely distributed.

As an example of conventional printers, an inkjet printer has a carriage inside, which feeds paper that is set to a paper tray into the printer and then repeats paper feeding and suspension to discharge the paper outside. While the carriage stops feeding the paper, a print head in the printer moves in the scan direction and injects ink through an ink nozzle, thereby making a print on the paper. In this way, conventional printers make printing by repeating the alternate operation of the print head moving and the carriage paper feeding.

An electric motor is generally used as the carriage. The electric motor, however, consumes a lot of electricity and makes lots of noise during operation.

In order to solve this drawback, a printer that does not have a carriage is proposed.

An example of the printer without a carriage is one that has a medium carrier to feed paper as a printing medium in the gravity direction by using gravity efficiently. For example, Japanese Unexamined Patent Application Publication No. 2003-266867 (FIGS. 1 and 2) describes a printer where a printing part (medium processing engine) is supported by hanging against a vertical wall through a suspension bracket and paper moves down through the printing part by its own weight so that the printing part makes a print on the paper.

On the other hand, a printer where a printing part (medium processing engine) moves in the gravity direction to make a print on paper is described in Japanese Unexamined Patent Application Publication No. 62-80076 (FIG. 1).

Since the above printers have no carriage, the printing part performs printing on a printing medium without stopping the printing medium or the printing part. This causes print displacement due to the movement of the printing medium or the printing part during printing.

Particularly in an inkjet printer, a printing medium or a printing part moves in the gravity direction while a print head moves in the scan direction. This causes a printed result on a printing medium to be distorted obliquely.

As described above, the present invention has recognized that, though the techniques described in Japanese Unexamined Patent Application Publication No. 2003-266867 and 62-80076 have achieved elimination of a carriage by making efficient use of the movement of a printing medium or a printing part in the gravity direction, they have a problem that different printing information from original information is printed.

SUMMARY OF THE INVENTION

According to an embodiment of the present invention, there is provided a printer that includes a printing part printing inputted printing information on a printing medium while moving by gravity and a support supporting the printing part and the printing medium facing each other so that one of the printing part and the printing medium is movable in a gravity direction, wherein the printing part corrects the inputted printing information according to a moving distance and a moving speed of one of the printing part and the printing medium and prints corrected printing information on the printing medium.

This structure allows accurate printing of original information while efficiently using the movement of a printing medium or a printing part in the gravity direction.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

The structure of a printer according to an embodiment of the present invention is described hereinafter with reference to the drawings.

Figure 1A:
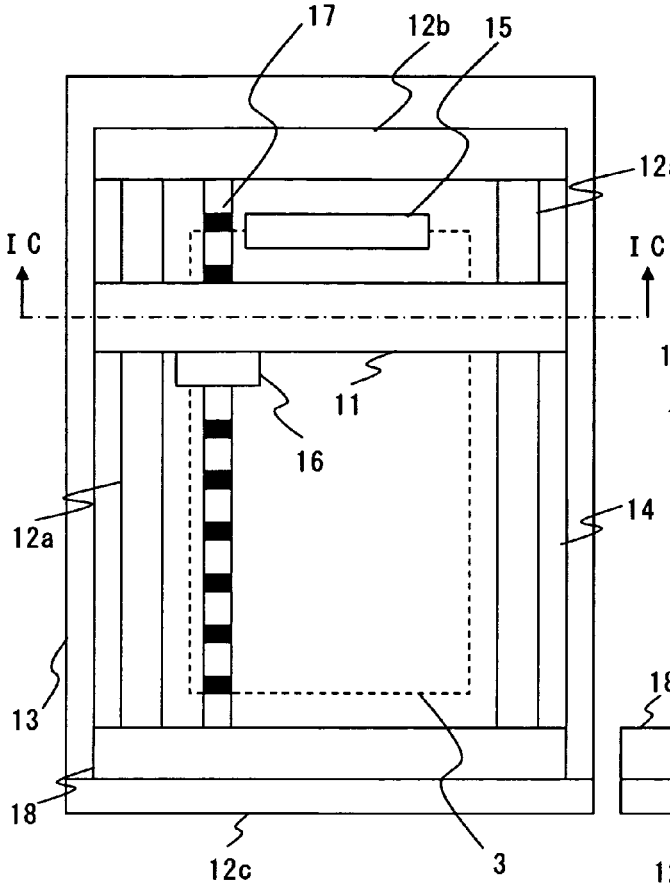
FIG. 1A is a schematic front elevation view showing the structure of a printer according to an embodiment of the present invention.
Figure 1B:
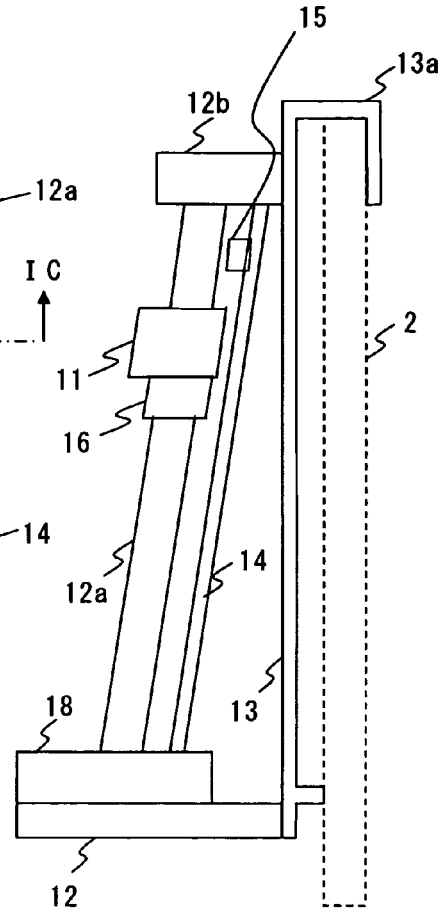
FIG. 1B is a schematic side elevation view showing the structure of the printer according to the embodiment of the present invention.
Figure 1C:
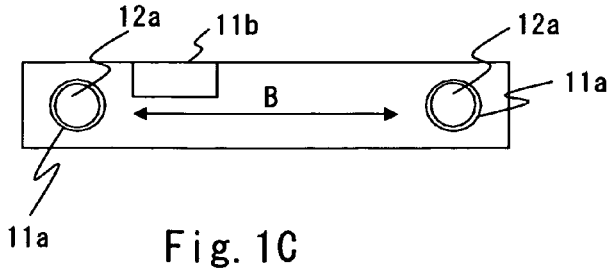
FIG. 1C is a cross-sectional view along line IC-IC in FIG. 1A.

FIGS. 1A to 1C are schematic views showing the structure of a printer of this embodiment. FIG. 1A is a front elevation view, FIG. 1B is a side elevation view, and FIG. 1C is a cross-sectional view along line IC-IC in FIG. 1A.

Referring to FIGS. 1A and 1B, a bracket 13 has a hook 13*a*, which is hanged on a vertical wall 2 (which is not a component of a printer 1) shown by a doted line. Supports 12*b* and 12*c* are fixed to and project from the upper end and the lower end of the bracket 13.

Referring to FIGS. 1A and 1C, both ends of two cylindrical supports 12*a* are connected and fixed to the supports 12*b* and 12*c*.

Referring to FIG. 1C, a printing part 11 has through-holes 11*a* that correspond to the cylindrical supports 12*a*. The printing part 11 is supported by the supports 12*a*, 12*b* and 12*c* so that it is movable in the gravity direction.

Further, a print media mount 14 is fixed to the supports 12*b* and 12*c* so as to be parallel with the supports 12*a*.

The supports 12*a*, 12*b*, 12*c*, and the print media mount 14 are formed of a metal material such as iron or a resin material such as plastic.

A holder 15, which is not a component of the printer 1, holds paper 3 as a printing medium against the print media mount 14.

The printing part 11 has a print head 11*b* that injects printing ink at predetermined time intervals. The print head 11*b* is movable inside the printing part 11 in the direction of an arrow B, which is a scan direction, shown horizontally in FIG. 1C.

A position sensor 16 detects the position of the printing part 11 by using a position indicator 17. The position sensor 16 is held by the printing part 11 and moves accompanying the movement of the printing part 11. FIG. 2 shows the specific structures of the position sensor 16 and the position indicator 17.

A printing part receiver 18 supports the printing part 11 that moves down along the gravity direction during printing so that it does not fall off the printer 1. The printing part receiver 18 is formed of a cushion material, for example.

Figure 2A:
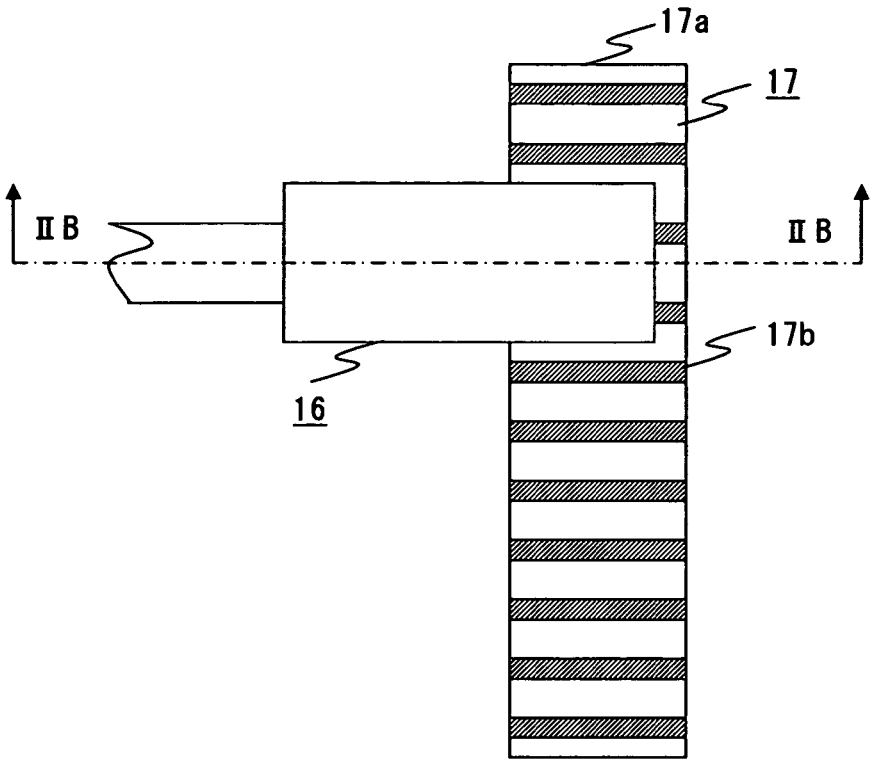
FIG. 2A is an enlarged front elevation view showing the structure of a position sensor and a position indicator of a printer according to an embodiment of the present invention.
Figure 2B:
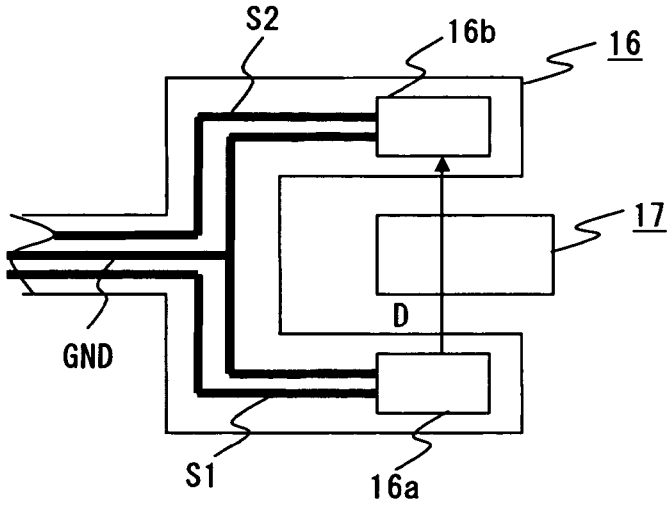
FIG. 2B is a cross-sectional view along line IIB-IIB in FIG. 2A.

FIGS. 2A and 2B are enlarged views showing the structure of the position sensor and the position indicator of the printer according to this embodiment. FIG. 2A is a front elevation view and FIG. 2B is a cross-sectional view along line IIB-IIB in FIG. 2A.

Referring to FIGS. 2A and 2B, the position sensor 16 is composed of a LED 16*a* that emits light and a photodiode 16*b* that receives light. The position indicator 17, which has light transmittance, is placed between the LED 16*a* and the photodiode 16*b*. Signal lines S1, S2 and GND of the position sensor 16 are connected to a controller (not shown) in the printing part 11 by distribution cables, for example. The position sensor 16 operates with power supply from the printing part The position indicator 17 is configured by applying light-shielding coating at predetermined intervals on the surface of a transparent member 17*a* such as a transparent tape. The part coated with the light-shielding coating is a light-shielding portion 17*b*.

The position sensor 16 and the position indicator 17 may be ones that are used for a normal printer.

When a voltage is applied to the LED 16*a* from the controller (not shown) of the printing part 11 through the signal line S1, the LED 16*a* emits light toward the photodiode 16*b*, which is in the direction D. The photodiode 16*b* detects light from the LED 16*a*. The photodiode 16*b* does detect light when the position sensor 16 passes through the light-shielding portion 17*b*. The photodiode 16*b* outputs the light detection as a detection signal to the printing part 11 through the signal line S2.

The printer 11 has a counter (not shown), which counts the number of detection signals supplied from the photodiode 16*b*.

The printing part 11 calculates a moving distance of the printing part 11 from the counted number of detection signals in the photodiode 16*b*. Further, the printing part 11 calculates a moving speed from the counted number of detection signals in the photodiode 16*b*, a measuring time by a timer, and so on.

Now, the electrical connection of a printing part of a printer according to an embodiment of the present invention is described hereinafter with reference to the drawings.

Figure 3:
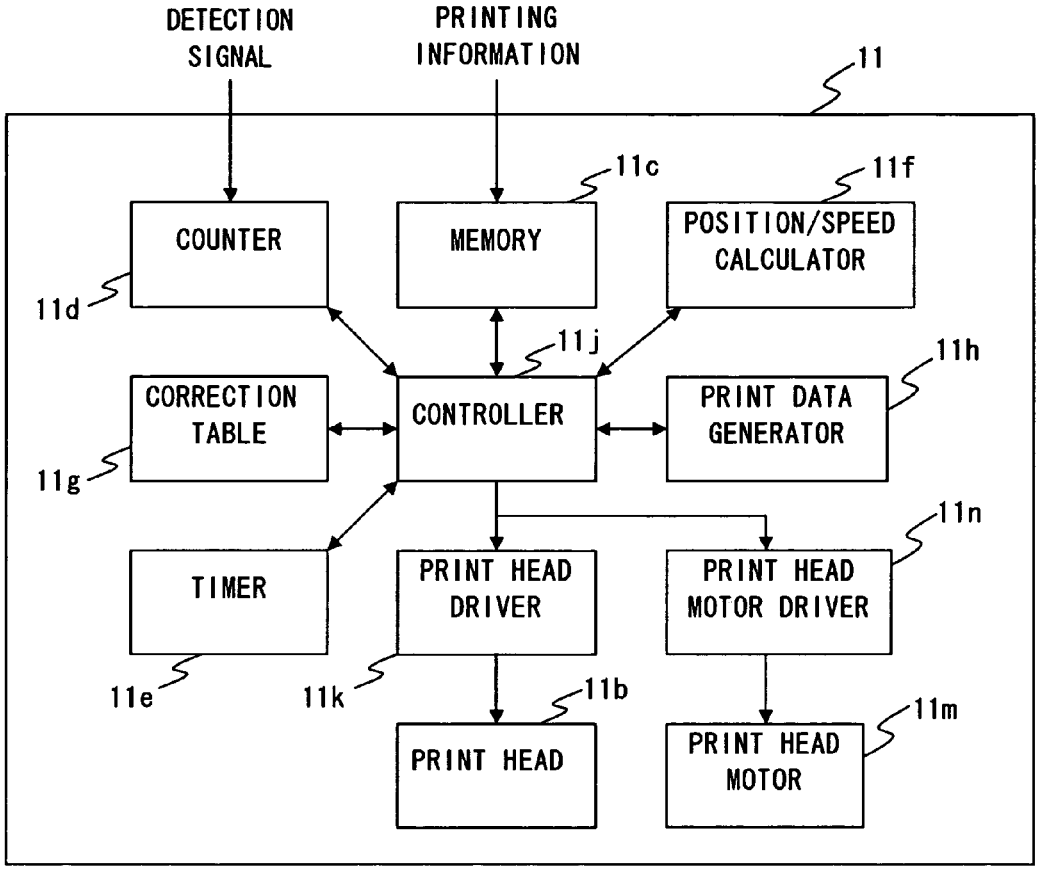
FIG. 3 is a block diagram showing electrical connection of a printing part of a printer according to an embodiment of the present invention.

FIG. 3 is a block diagram showing the electrical connection of the printing part of the printer according to this embodiment.

Referring to FIG. 3, a memory 11*c* stores printing information inputted by a personal computer (PC; not shown) that is connected to the printer 1.

A counter 11*d* counts a detection signal from the position sensor 16.

A timer 11*e* measures a time from the start of printing.

A position/speed calculator 11*f* calculates a moving distance and a moving speed of the printing part 11 in the gravity direction. For example, the moving distance of the printing part 11 is calculated by multiplying a count number of the counter 11*d* by a distance between the light-shielding portions 17*b* of the position indicator 17. The moving speed of the printing part 11 is calculated each time a detection signal from the position sensor 16 is input to the counter 11*d*. For example, it is assumed that the upper end of the position indicator 17 of the printing part 11 is a reference and the number of light-shielding portions 17*b* of the position indicator 17 is n. It is also assumed that a distance from the upper end of the position indicator 17 when the printing part 11 passes the light-shielding portion 17*b* at the n-th position from the upper end of the position indicator 17 is y(n), which is positive when falling downward, and a time that the printing part 11 moves from the upper end of the position indicator 17 to the n-th light-shielding portion 17*b* is t (n). In this case, a moving speed v(n) of the printing part 11 at y(n) may be approximately calculated as follows:

$$v(n)=\{y(n)-y(n-1)\}/\{t(n)-t(n-1)\} \quad \text{Formula 1;}$$

A correction table 11*g* stores correction coefficients α and β that are correction information to correct printing information according to the moving distance and the moving speed of the printing part 11 so as to accurately print the data of printing information that is inputted by a PC. The correction table 11*g* may be Random Access Memory (RAM) or Read Only Memory (RCM) that are used for a normal printer.

If the number of print dots from the upper end of the position indicator 17, which is a reference, is i, for example, the following formula may be used to correct the printing information that is inputted by PC in order to print it accurately. If a distance from the upper end of the position indicator 17 (reference) to the i-th print dot is y(i), a moving speed of the printing part 11 at y(i) is v(i), and correction coefficients are α and β, a distance y(i+1) to the (i+1)th print dot is calculated as follows:

$$y(i+1)=y(i)+\alpha*v(i)*[t(i+1)-t(i)]+\beta \quad \text{Formula 2;}$$

The v(i) maybe substituted by v(n) where y(i)≈y(n), for example. The correction coefficients α and β are determined by comparing original printing information inputted by PC with printed results of the printing information before correction and analyzing printing displacement and print dot interval displacement. Data of the correction coefficients α and β is accumulated in the correction table 11*g* by repeating test printing a large number or times, which allows reduction of manufacturing variation in the printer, for example. The correction coefficients set in the above formula is just an example, and they are not limited thereto.

For example, it is feasible to change the friction coefficient of the surfaces of the supports 12*a* so that it becomes higher toward the bottom in order that the moving speed of the printing part 11 is constant. In this case, a load of the printing part 11 in the gravity direction, a reaction force that the printing part 11 receives from the surfaces of the supports 12*a* and so on are measured at each point of measurement of a moving distance, and the friction coefficient is set for each point of measurement.

A print data generator 11*h* corrects the inputted printing information by using the correction coefficients α and β that are stored in the correction table 11*g* and also corrects a printing ink injection time of the print head 11*b* (formula not presented herein) through a controller 11*j*. The print data generator 11*h* thereby generates corrected printing information and stores it temporarily.

A method of correcting a printing ink injection time of a print head is described hereinafter with reference to the drawings.

Figure 4:
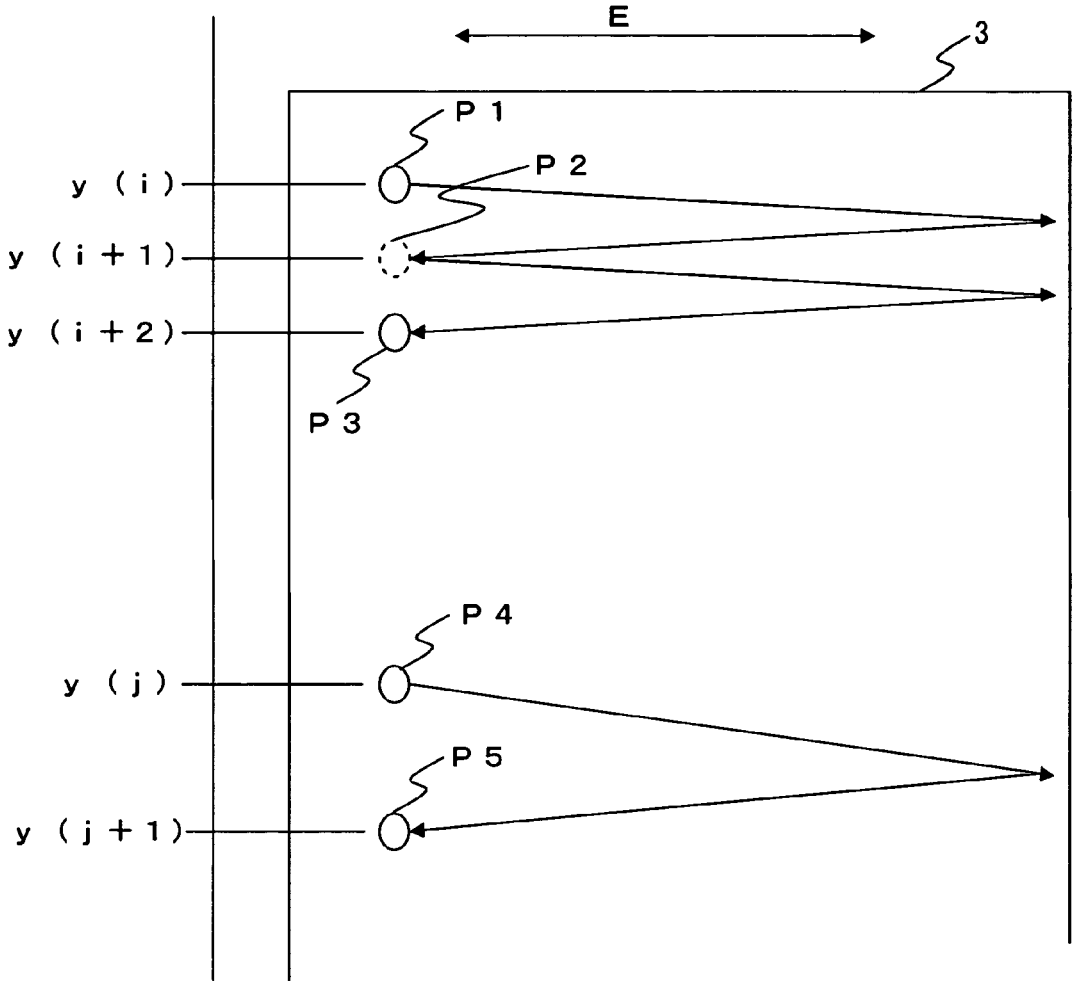
FIG. 4 is a view to describe a way of correcting a printing ink injection time by a print head.

FIG. 4 is a view to describe a way of correcting a printing ink injection time by a print head.

Referring to FIG. 4, i and j represent the number of print dots from the upper end of the position indicator 17 as a reference, and they satisfy j>i. They thus satisfy y(j)>y(i), and a moving speed that the printing part 11 passes through y(j) is higher than a moving speed that it passes through y(i) since acceleration of gravity is applied longer. Therefore, if the print head 11*b* injects printing ink in y(i) and y(j) at the same time intervals, a distance between print dots differs to cause distortion in printed results.

For example, it is assumed that the moving speed that the printing part 11 passes through y(j) is twice the moving speed that it passes through y(i). Then, it can be approximately calculated as:

$$|y(j+1)-y(j)|\approx 2*|y(i+1)-y(i)|\approx|y(i+2)-y(i)|$$

Further, it is assumed that, during each of time periods from when the printing part 11 prints a print dot P1 to when it prints a print dot P2 and from when it prints a print dot P2 to when it prints a print dot P3, the printing head 11*b* once goes and returns the paper 3 shown in FIG. 4 in the width direction. If the moving speed of the print head 11*b* in the scan direction (the direction D in FIG. 1C and the direction E in FIG. 4) is constant, the printing head 11*b* once goes and returns the paper 3 shown in FIG. 4 in the width direction during a time period between printing of a print dot P4 and a print dot P5.

In this case, in order to equalize a distance between print dots at y(i) and y(j), the print head 11*b* may stop injecting printing ink while the printing part 11 moves from y(i) to y(i+1), for example. It is assumed here that |y(j+1)−y(j)|≈|y(i+2)−y(i)|. In this way, the print dot P2 in FIG. 4 is not printed, thus allowing the distance between print dots to be the same at y(i) and y(j).

A printing ink injection time of the print head 11*b* is thereby corrected in accordance with the moving speed of the printing part 11, for example.

Referring back to FIG. 3, a print head driver 11*k* generates control information of image data to be injected by the print head 11*b* and transmits the generated image data control information to the print head 11*b*.

A print head motor driver 11*n* controls the operation of the print head 11*b* in the direction B in FIG. 1C and transmits operation control information to a print head motor 11*m*.

The controller 11*j* controls all the components shown in FIG. 3. The controller 11*j* determines a printing ink injection time and an injection position of the print head 11*b* and a print head drive waveform based on corrected printing information that is generated in the print data generator 11*h*. According to this determination, the controller 11*j* supplies a print command signal to the print head motor 11*m* through the print head motor driver 11*n* and also supplies a print command signal to the print head 11*b* through the print head driver 11*k*.

A printing process of a printer according to an embodiment of the invention is described hereinafter with reference to the drawings.

Figure 5:
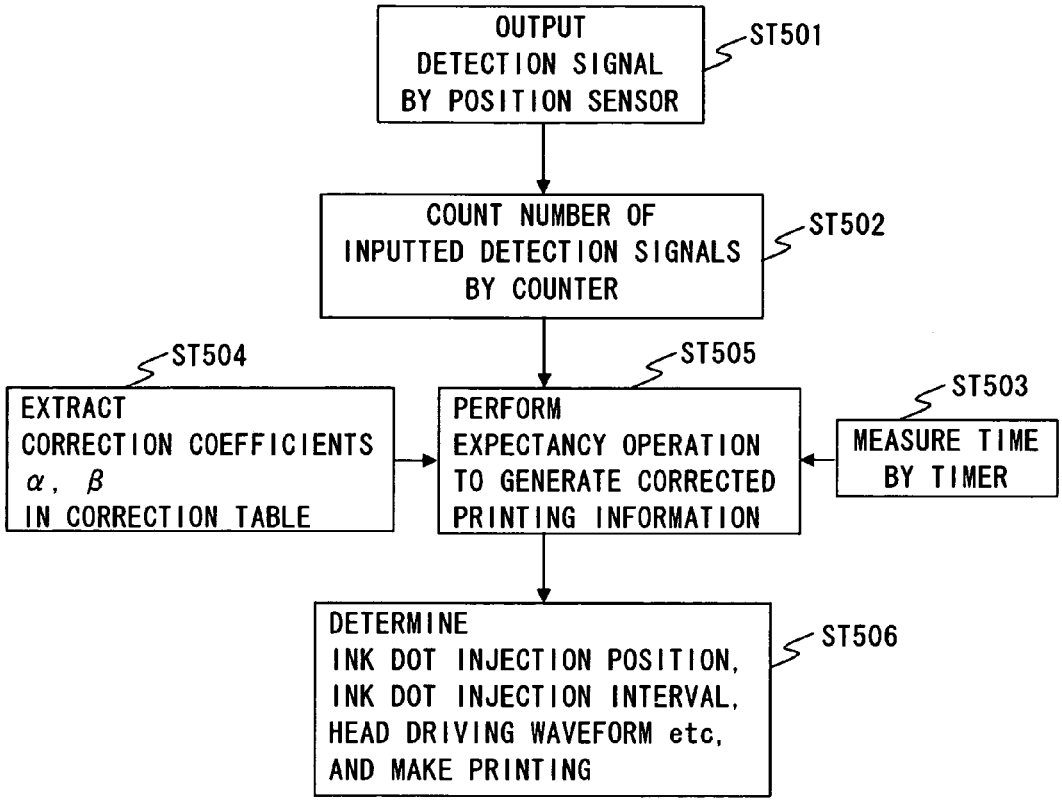
FIG. 5 is a view showing a printing process of a printer according to an embodiment of the present invention.

FIG. 5 is a view showing a printing process of a printer of this embodiment.

Referring to FIGS. 1, 2, 3 and 5, after the printer receives printing information from PC, the printing part 11 moves in the gravity direction upon start of printing. As the printing part 11 moves, the position sensor 16 also moves in the gravity direction. While moving in the gravity direction, the position sensor 16 outputs a detection signal each time the photodiode 16*b* receives light from the LED 16*a* (ST501).

Then, the counter 11*d* counts the number of detection signals inputted from the position sensor 16 (ST502).

The timer 11*e* measures a time from the start of printing (ST503).

The position/speed calculator 11*f* calculates a moving distance of the printing part 11 from a count number inputted from the counter 11*d* and further calculates a moving speed of the printing part 11 from the moving distance and a time inputted from the timer 11*e* through the controller 11*j*. Then, the controller 11*j* feeds back the calculated moving distance and moving speed from the correction table 11*g* and extracts correction coefficients α and β corresponding to the moving distance and moving speed (ST504).

Then, the controller 11*j* performs expectancy operation including a print position of a dot and an injection time of printing ink and corrects printing information to generate corrected printing information (ST505).

After that, the controller 11*j* specifically determines a printing ink injection time and an injection position of the print head 11*b* and a print head drive waveform and so on from the corrected printing information that is generated in the print data generator 11*h*. According to this determination, the controller 11*j* supplies a printing command signal to the print head motor 11*m* and the print head 11*b*, and the print head 11*b* prints the corrected printing information on the paper 3 (ST506).

Figure 6:
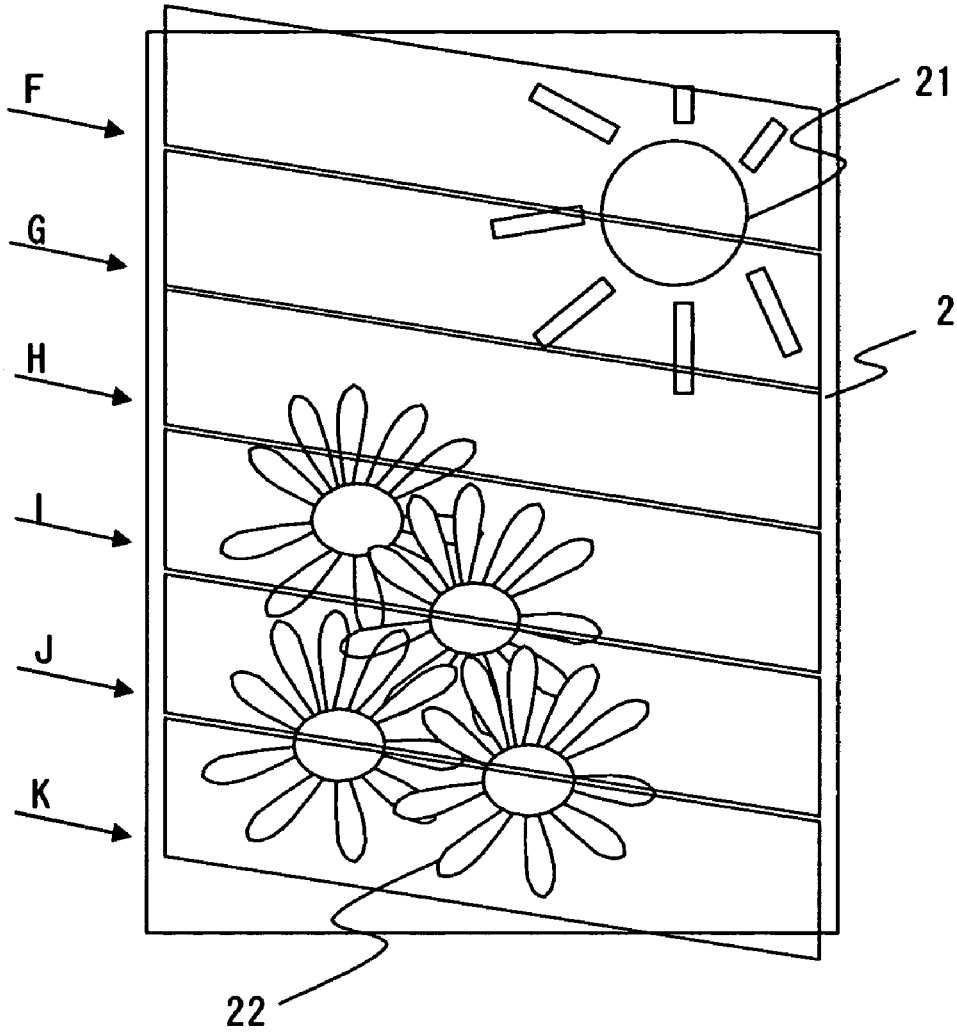
FIG. 6 is a view to describe the movement of a printing paper and a print head on the printing paper in the printing of corrected information.

FIG. 6 shows the result of printing by the printer 1. FIG. 6 is a view to describe the movement of a printing paper and a print head on the printing paper when corrected printing information is printed.

Referring to FIG. 6, arrows F to K indicate the moving direction of the print head 11*b* when printing. Though the arrows F to K are not all parallel actually, FIG. 6 illustrates them being parallel to each other for simplification.

The printing information is images of a sun 21 and a plurality of flowers 22. The printer 1 of this embodiment performs expectancy operation of the moving direction of the print head indicated by the arrows F to K based on the moving distance and moving speed of the printing part 11, the correction coefficients as correction information stored in the correction table and so on. Then, the printer 1 corrects the inputted printing information and prints the corrected printing information. It is thereby possible to print the original printing information accurately without distortion of a printed image as shown in FIG. 6.

As described in the foregoing, the present invention provides a printer and a printing method that allow accurate printing of original printing information.

Although the above embodiment takes paper as an example of the printing medium, the printing medium is not limited to a two-dimensional object such as paper and a three-dimensional object may be used.

Further, though the above embodiment describes the case where the printer 1 holds the paper 3 unmovably and moves the printing part 11 in the gravity direction, the present invention may be also applied to the case where the printer 1 holds the printing part 11 unmovably and moves the paper 3 in the gravity direction, as described in Japanese Unexamined Patent Application Publication No. 2003-266867.

Furthermore, though the above embodiment describes the inkjet printer as an example, the present invention is also applicable to thermal-transfer printers and laser printers, for example.

It is apparent that the present invention is not limited to the above embodiment that may be modified and changed without departing from the scope and spirit of the invention.

What is claimed is:

1. A printer comprising:

a printing part printing inputted printing information on a printing medium while the printing part moves by gravity;

a support supporting the printing part and the printing medium facing each other so that one of the printing part and the printing medium is movable in a gravity direction;

a light emitter moving together with the printing part;

a light receiver placed facing the light emitter and moving together with the printing part;

an indicator with light transmittance placed between the light emitter and the light receiver and having a plurality of light-shielding portions arranged in a gravity direction at predetermined intervals;

a counter counting the number of times that the light receiver receives light from the light emitter; and a timer measuring a printing time, wherein the printing part corrects the inputted printing information according to a moving distance and a moving speed of one of the printing part and the printing medium and prints corrected printing information on the printing medium, and wherein the moving distance is calculated based on a count value of the counter, and the moving speed is calculated based on the count value of the counter and a printing time measured by the timer.

2. A printer comprising:

a memory storing inputted printing information;

a printing part printing the printing information on a printing medium while the printing part moves by gravity;

a holder holding the printing medium;

a support supporting the printing part and the printing medium facing each other so that the printing part is movable in a gravity direction;

a calculator calculating a moving distance and a moving speed of the printing part; and a correction table storing correcting information that corrects the printing information stored in the memory according to the moving distance and the moving speed of the printing part;

wherein the printing part corrects the printing information stored in the memory by using the correction information stored in the correction table and prints corrected printing information on the printing medium.

3. The printer according to claim 2, comprising: a light emitter moving together with the printing part;

a light receiver placed facing the light emitter and moving together with the printing part;

an indicator with light transmittance placed between the light emitter and the light receiver and having a plurality of light-shielding portions arranged in a gravity direction at predetermined intervals;

a counter counting the number of times that the light receiver receives light from the light emitter; and a timer measuring a printing time, wherein the moving distance is calculated based on a count value of the counter, and the moving speed is calculated based on the count value of the counter and a printing time measured by the timer.

4. The printer according to claim 2, wherein the printing part comprises a print head ejecting printing ink, and the print head ejects the printing ink according to a moving distance and a moving speed of the printing part.

* * * * *